United States Patent [19]

Wedge

[11] 4,355,472

[45] Oct. 26, 1982

[54] DRAFTING AID

[76] Inventor: Richard Wedge, 11927 Venice Blvd., #4, Los Angeles, Calif. 90066

[21] Appl. No.: 180,646

[22] Filed: Aug. 25, 1980

[51] Int. Cl.[3] ..... B43L 7/00

[52] U.S. Cl. ..... 33/486

[58] Field of Search ..... 33/173, 483, 486, 487, 33/488, 494, 403, 158; 116/304, 306, 322–324, DIG. 23; 235/70 B; 350/116

[56] References Cited

U.S. PATENT DOCUMENTS

| | | | |
|---|---|---|---|
| 953,464 | 3/1910 | Heller et al. | 33/158 |
| 998,616 | 7/1911 | Jewell | 33/158 |
| 1,110,195 | 9/1914 | Erwin | 33/486 |
| 1,215,663 | 2/1917 | Krueger | 33/486 |
| 1,602,490 | 10/1926 | Homan | 33/494 X |
| 2,456,676 | 12/1948 | Chowns | 33/486 |
| 3,672,061 | 6/1972 | Alessi | 33/494 X |

*Primary Examiner*—Harry N. Haroian

*Attorney, Agent, or Firm*—Cislo, O'Reilly & Thomas

[57] ABSTRACT

A drafting aid particularly useful for association with T-squares and the like wherein a vertical or normal datum point is easily obtained and wherein the drafting aid is movable about the extent of the T-square or other linear edge with which the device is used. In an exemplary embodiment the drafting aid comprises a vertically oriented member in association with a ruler or the like comprising the linear edge and the combination is associated with a T-square so as to have not only a means of aiding in the placement of vertical reference lines but also a means of ease of measuring distances between vertical reference points or lines.

9 Claims, 7 Drawing Figures

DRAFTING AID

BACKGROUND OF THE INVENTION

Any draftsman or the like that has engaged in mechanical drawing wherein T-square and right triangles are utilized realizes that many times it is cumbersome to have to use a triangle for the placement of a vertical point line for reference because of the necessity of using the vertical edge of one of the triangles in association with the horizontal edge or surface of the T-square.

Additionally, it becomes cumbersome in drafting and drawing to have to utilize a ruler of any type for proper vertical alignment spacing of points, lines and the like. With the herein disclosed invention a drafting aid or appliance is associable with a T-square in order to provide a means of obtaining vertical orientation (with respect to the linear edge and the like with which it is utilized) in a facile manner. Additionally, where the drafting aid or appliance is associated with a linear edge or ruler having spaced indicia markings in terms of measurement, means are provided whereby a single appliance or device substitutes for triangles and a separate scale or ruler.

OBJECTS AND SUMMARY OF INVENTION

It is an object of the invention to provide a drafting aid for obtaining vertically oriented reference or datum points.

It is another further object of the invention to provide a drafting aid or appliance which is particularly useful with T-squares and the like.

It is another even further, more specific object of the invention to provide a drafting aid, device or appliance which is associable with a linear edge ruler and the like which itself is attachable in releasable fashion to a T-square.

It is another even further, more specific object of the invention to provide a drafting aid device wherein an integral member is associated with a linear edge or scale in captive and slidable relationship and having a central point which determines in normal fashion a vertically oriented datum with respect to the linear edge or ruler with which the appliance or device is used.

It is an even further, even more specific object of the invention to provide a drafting aid appliance of integral construction wherein a vertical datum point is provided in conjunction with a linear edge wherein the member is captively received for slidable movement but is capable of rigid retention in the normal orientation with respect to the linear edge with which it is used.

Generally, in an exemplary embodiment the invention is directed to a drafting aid comprising the combination of an integral member having an under surface adapted for slidable captive association with a linear edge and having a protuberance generally defining a normal reference relative to the linear edge and having cooperative means for fixed securement with said linear edge. The cooperative means are normally disposed in the fixed securing position and are releasable in a facile manner for linear movement of said integral member about the extent of the linear edge.

These and further objects of the invention will become apparent with reference to the hereinafter following commentary taken in conjunction with the figures of drawing.

DESCRIPTION OF THE BEST EMBODIMENTS CONTEMPLATED

Figure 1:
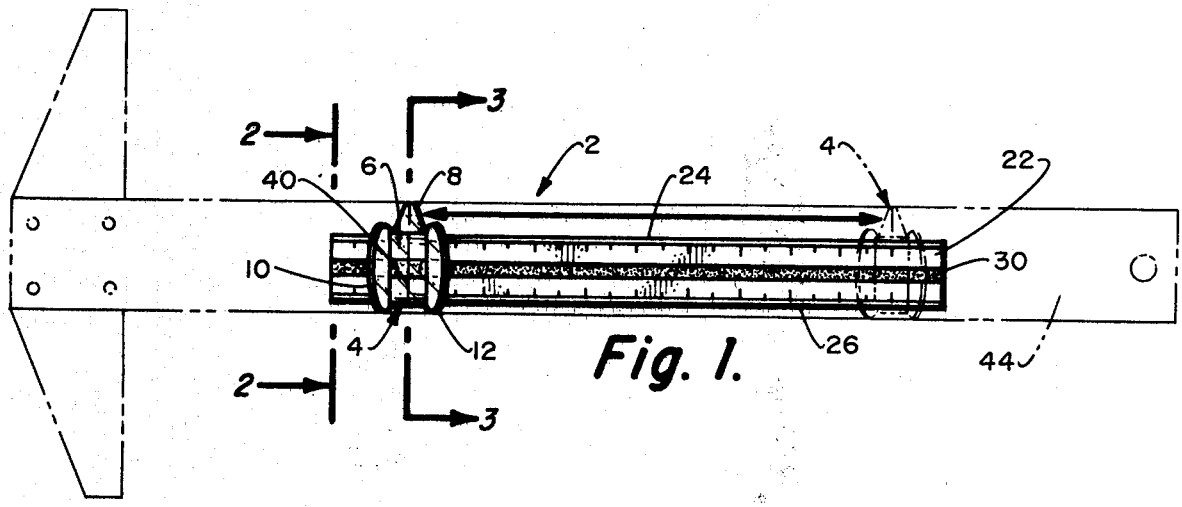
FIG. 1 is a plan view of one embodiment of the device of the invention showing its use with a T-square which is illustrated in phantom line and also showing in phantom line the transverse or linear movement of the device.
Figure 2:
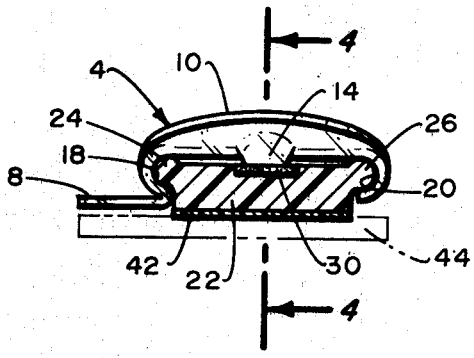
FIG. 2 is a view taken along the line of 2—2 of FIG. 1 and enlarged to better illustrate some of the details of construction of the device of the invention.
Figure 3:
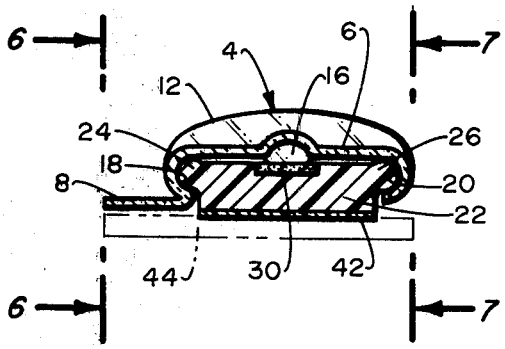
FIG. 3 is a view similar to FIG. 2, but taken along the line 3—3 of FIG. 1.

Referring to the figures of drawing wherein like numerals of reference designate like elements throughout, it will be noticed that the drafting aid or appliance 2 of the invention comprises an integral member generally designated as 4, in this particular instance having a clear or transparent, plastic integral configuration with a central portion 6 having protuberance 8 defining a normal reference and having opposed ears 10 and 12 with depending abutment portions 14 and 16 for reasons which will become apparent as the description proceeds herein.

The undersurface of the member 4 is configured so as to define channels 18 and 20 for association, in the embodiment illustrated, with a linear scale or ruler 22 and more specifically, the bead-like protuberances 24 and 26 extending the lateral length of scale or rule member 22.

The body member 4 is of flexible material and of relative low weight but high strength plastic and is formed as an integral member although those of ordinary skill in the art will of course recognize that the attributes of the invention may be attained in other than integral construction of the member 4.

Figure 5:
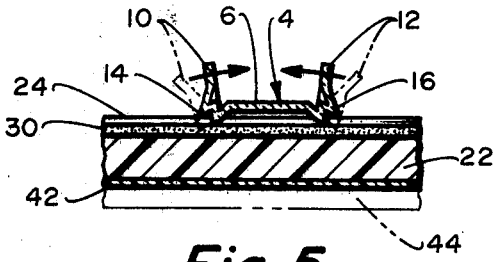
FIG. 5 is a view similar to FIG. 4 but illustrating the secured and unsecured relationship of the device in conjunction with a linear edge or the like with which it may be used.
Figure 6:
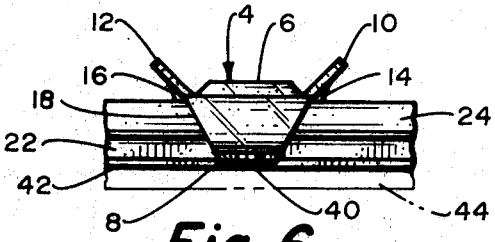
FIG. 6 is a fragmented view taken along the line of 6—6 of FIG. 3.
Figure 7:
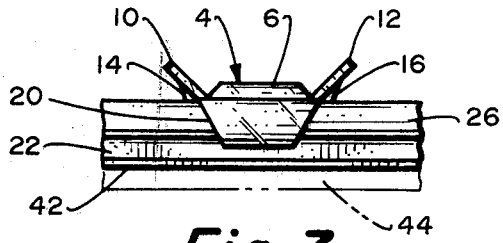
FIG. 7 is a view taken along the line 7—7 of FIG. 3.

The upstanding ears 10 and 12 may be compressed or moved towards one another by means of the thumb and forefinger of the human hand as best illustrated in the dotted line showing of FIG. 5 to thus disengage the depending abutment stops 14 and 16 from engaging a central, high-friction, material strip 30 carried in the upper surface of the linear rule or scale 22.

Figure 4:
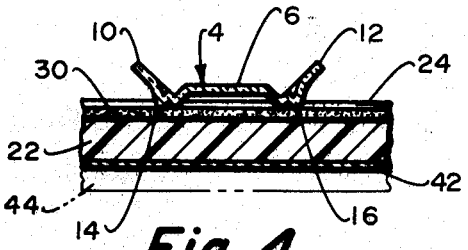
FIG. 4 is a fragmented view taken along the line 4—4 of FIG. 2.

Referring to FIG. 4 it will be noted that in the normal position the ears 10 and 12 are so positioned that the lower depending abutments 14 and 16 engage the friction strip 30 in high friction retaining relationship. However, inwardly flexing the ears 10 and 12, the abutments 14 and 16 are pivoted out of contact as best seen in FIG. 5 so that the member 4 may be slidably moved by reason of the beads 24 and 26 and channels 18 and 20, respectively, along the extent of the scale or rule 22 to the phantom line position as seen in FIG. 1.

It will be noted that the scale or linear edge 22 is provided with measurement indicia so that by reason of the hairline 40 in the approximate center of body 6 of member 4 vertically oriented lines, points or datum lines, may be formulated. The undersurface of scale 22 may be provided with double-backed adhesive strip 42 so that the associated device 2 may be secured in rigid fashion to the upper surface of the T-square 44 as illustrated in the phantom line showings.

While specific configurations and details of construction for the device 2 have been illustrated, those of ordinary skill in the art will of course recognize that various modification and changes may be made. For example, body member 4 may be modified and a T-square modified so as to provide for the cooperative association of the body member 4 with the T-square itself, and of course the T-square would then be modified in order to have linear indicia markings so as to obtain the full range of use of the body member 4 in the modified use thereof.

Thus, there has been disclosed a drafting aid or appliance for special use with T-squares and the like, which permits ease of obtaining vertical reference points or lines and all facets of the invention are claimed as more fully set forth in the appended claims.

I claim:

1. A drafting aid comprising the combination of:

a linear member having spaced, lateral, bead-like protuberances extending the length thereof, an integral member having an inside surface configuration defining spaced channels to receive said bead-like protuberances on said linear member for slidable movement in cooperation with said linear member and having a protuberance generally defining a normal reference relative to said linear member, and having cooperative means for fixed securement with said linear member, said cooperative means being normally disposed in the fixed securement position and releasable for linear movement of said integral member along the extent of said linear member, said cooperative means comprising upstanding ears having depending abutment stops that engage said linear member in high friction manner between said bead-like protuberances and wherein said cooperative means are flexible to disengage said abutment stops for sliding movement along the extent of said linear member.

2. The drafting aid in accordance with claim 1, wherein said integral member is of clear, transparent, plastic.

3. The drafting aid in accordance with claim 2, wherein said integral member is provided with a central, vertically-oriented, datum line and is adapted for association with a T-square or the like.

4. The drafting aid in accordance with claim 1, wherein said linear member comprises a linear scale having linear indicia markings thereon and wherein said integral member has a centrally located normal reference line.

5. A drafting aid comprising the combination of:

a linear member having spaced, lateral, bead-like protuberances extending the length thereof, an integral member having an inside surface configuration defining spaced channels to receive said bead-like protuberances on said linear member for slidable movement in cooperation with said linear member and having a protuberance generally defining a normal reference relative to said linear member, and having cooperative means for fixed securement with said linear member, said cooperative means being normally disposed in the fixed securement position and releasable for linear movement of said integral member along the extent of said linear member, said integral member having a centrally located normal reference line and said linear member comprising a linear scale having linear indicia markings thereon and being positioned between said bead-like protuberances.

6. The drafting aid in accordance with claim 5, wherein said protuberance comprises a central pointer portion extending from said integral member and being aligned with said normal reference line.

7. The drafting aid in accordance with claim 6, wherein said cooperative means comprises upstanding ears having depending abutment stops that engage the approximate center of said linear scale in high friction manner and wherein said cooperative means are flexible to disengage said abutment stops for sliding movement along the extent of said linear scale.

8. The drafting aid in accordance with claim 7, including means to fixedly secure said linear scale to a T-square or the like, and wherein said linear scale is provided with a central strip of high friction material to engage said abutment stops.

9. The drafting aid in accordance with claim 8, wherein said strip of high friction material comprises rubber-coated, adhesive tape.

* * * * *